US007630669B2

(12) United States Patent
Banton

(10) Patent No.: US 7,630,669 B2
(45) Date of Patent: Dec. 8, 2009

(54) MULTI-DEVELOPMENT SYSTEM PRINT ENGINE

(75) Inventor: Martin E. Banton, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 682 days.

(21) Appl. No.: 11/349,828

(22) Filed: Feb. 8, 2006

(65) Prior Publication Data

US 2007/0183811 A1 Aug. 9, 2007

(51) Int. Cl.
*G03G 15/06* (2006.01)

(52) U.S. Cl. ..... 399/222

(58) Field of Classification Search ..... 399/222
See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco et al.
5,004,222 A 4/1991 Dobashi
5,080,340 A 1/1992 Hacknauer et al.
5,095,342 A 3/1992 Farrell et al.
5,159,395 A 10/1992 Farrell et al.
5,208,640 A 5/1993 Horie et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A 10/1996 Keller et al.
5,570,172 A 10/1996 Acquaviva
5,596,416 A 1/1997 Barry et al.
5,613,176 A * 3/1997 Grace ..... 399/223
5,629,762 A 5/1997 Mahoney et al.
5,710,968 A 1/1998 Clark et al.
5,778,377 A 7/1998 Marlin et al.
5,837,408 A * 11/1998 Parker et al. ..... 399/232
5,884,910 A 3/1999 Mandel
5,995,721 A 11/1999 Rourke et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—David M. Gray
*Assistant Examiner*—Erika J. Villaluna
(74) *Attorney, Agent, or Firm*—Fay Sharpe, LLP

(57) ABSTRACT

A multi-purpose print platform includes a color print engine with color and black toners and a low-cost-per-page print engine having at least two image development systems in which each of the development systems is associated with a different type of black toner and/or highlight color toners. Jobs that include color and black and/or highlight color pages can be processed by using both print engines. The low-cost-per-page print engine typically is low cost in that it facilitates processing pages at a low per page cost relative to color and/or high cost black print engines while providing the productivity and reliability of a typical black only print engine.

15 Claims, 7 Drawing Sheets

U.S. PATENT DOCUMENTS

| | | | |
|---|---|---|---|
| 6,059,284 | A | 5/2000 | Wolf et al. |
| 6,125,248 | A | 9/2000 | Moser |
| 6,241,242 | B1 | 6/2001 | Munro |
| 6,297,886 | B1 | 10/2001 | Cornell |
| 6,341,773 | B1 | 1/2002 | Aprato et al. |
| 6,384,918 | B1 | 5/2002 | Hubble, III et al. |
| 6,450,711 | B1 | 9/2002 | Conrow |
| 6,476,376 | B1 | 11/2002 | Biegelsen et al. |
| 6,476,923 | B1 | 11/2002 | Cornell |
| 6,493,098 | B1 | 12/2002 | Cornell |
| 6,537,910 | B1 | 3/2003 | Burke et al. |
| 6,550,762 | B2 | 4/2003 | Stoll |
| 6,554,276 | B2 | 4/2003 | Jackson et al. |
| 6,577,925 | B1 | 6/2003 | Fromherz |
| 6,607,320 | B2 | 8/2003 | Bobrow et al. |
| 6,608,988 | B2 | 8/2003 | Conrow |
| 6,612,566 | B2 | 9/2003 | Stoll |
| 6,612,571 | B2 | 9/2003 | Rider |
| 6,621,576 | B2 | 9/2003 | Tandon et al. |
| 6,633,382 | B2 | 10/2003 | Hubble, III et al. |
| 6,639,669 | B2 | 10/2003 | Hubble, III et al. |
| 6,819,906 | B1 | 11/2004 | Herrmann et al. |
| 6,925,283 | B1 | 8/2005 | Mandel et al. |
| 6,959,165 | B2 | 10/2005 | Mandel et al. |
| 6,973,286 | B2 | 12/2005 | Mandel et al. |
| 2002/0078012 | A1 | 6/2002 | Ryan et al. |
| 2002/0103559 | A1 | 8/2002 | Gartstein |
| 2003/0077095 | A1 | 4/2003 | Conrow |
| 2004/0085561 | A1 | 5/2004 | Fromherz |
| 2004/0085562 | A1 | 5/2004 | Fromherz |
| 2004/0088207 | A1 | 5/2004 | Fromherz |
| 2004/0150156 | A1 | 8/2004 | Fromherz et al. |
| 2004/0150158 | A1 | 8/2004 | Biegelsen et al. |
| 2004/0153983 | A1 | 8/2004 | McMillan |
| 2004/0216002 | A1 | 10/2004 | Fromherz et al. |
| 2004/0225391 | A1 | 11/2004 | Fromherz et al. |
| 2004/0225394 | A1 | 11/2004 | Fromherz et al. |
| 2004/0247365 | A1 | 12/2004 | Lofthus et al. |

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.

* cited by examiner

MULTI-DEVELOPMENT SYSTEM PRINT ENGINE

BACKGROUND

The following relates to printing platforms. It finds particular application to printing platforms employing a multi-development system low-cost-per-page print engine having at least two different toners.

In conventional xerography, an electrostatic latent image is created on the surface of a photoconducting insulator and subsequently transferred to a final receiving substrate or medium. This typically involves the following. An electrostatic charge is deposited on the photoreceptor surface (e.g., by a corona discharge). The photoreceptor is exposed, which selectively dissipates the surface charge in the exposed regions and creates a latent image in the form of an electrostatic charge pattern. The image is developed by transferring electrostatically charged toner particles to the photoreceptor surface. The toner particles are then transferred to a receiving substrate or to one or more intermediate transfer elements and then to the receiving substrate. The transferred image is made permanent by various techniques, including pressure, heat, radiation, solvent, or some combination thereof.

With conventional systems, a print job that includes both color and black pages typically is processed using a color engine, wherein color toner is used to process the color pages and black toner is used to process black pages. This results in consistency of the black portions of the transferred images between the color and the black and white pages. However, using the black toner from a color engine to process a black and white page may be inefficient in that color engines typically are relatively slower than monochrome black toner engines and more costly on a per page basis. With conventional systems having both color and black engines, matching the black from the color engine with the black from the black engine may not possible since the black toner used with color engines typically is a glossy black, while the black toner used with black engines typically is a flat black. Thus, using such engines for processing the same print job may render pages with visually different looking black.

CROSS REFERENCE TO RELATED PATENTS AND APPLICATIONS

The following applications, the disclosures of each being totally incorporated herein by reference are mentioned:

U.S. application Ser. No. 10,761,522 , filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211 , filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619 , filed Jun. 30,2004, entitled "FLEXIBLE PAPER PATH USING MULTIDIRECTIONAL PATH MODULES," by Daniel G. Bobrow;

U.S. application Ser. No. 10/917,768, filed Aug. 13,2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23,2004, entitled "PRINTING SYSTEM WITH HORIZONTAL HIGHWAY AND SINGLE PASS DUPLEX," by Robert M. Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 11/089,854, filed Mar. 25,2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/094,998, filed Mar. 31,2005, entitled "PARALLEL PRINTING ARCHITECTURE WITH PARALLEL HORIZONTAL PRINTING MODULES," by Steven R. Moore, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/166,581, filed Jun. 24,2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/208,871, filed Aug. 22,2005, entitled "MODULAR MARKING ARCHITECTURE FOR WIDE MEDIA PRINTING PLATFORM," by Edul N. Dalal, et al.;

U.S. application Ser. No. 11/248,044, filed Oct. 12,2005, entitled "MEDIA PATH CROSSOVER FOR PRINTING SYSTEM," by Stan A. Spencer, et al.; and U.S. application Ser. No. 11/291,583, filed Nov. 30, 2005, entitled "MIXED OUTPUT PRINTING SYSTEM," by Joseph H. Lang;

U.S. application Ser. No. 11/312,081, filed Dec. 20, 2005, entitled "PRINTING SYSTEM ARCHITECTURE WITH CENTER CROSS-OVER AND INTERPOSER BY-PASS PATH," by Barry P. Mandel, et al.;

U.S. application Ser. No. 11/317,589, filed Dec. 23, 2005, entitled "UNIVERSAL VARIABLE PITCH INTERFACE INTERCONNECTING FIXED PITCH SHEET PROCESSING MACHINES," by David K. Biegelsen, et al., and U.S. application Ser. No. 11/331,627, filed Jan. 13, 2006, entitled "PRINTING SYSTEM INVERTER APPARATUS," by Steven R. Moore.

U.S. application Ser. No. 11/331,627, filed Jan. 13, 2006, entitled "PRINTING SYSTEM INVERTER APPARATUS," by Steven R. Moore.

BRIEF DESCRIPTION

In one aspect, a multi-purpose print platform is illustrated. The multi-purpose print platform includes a low-cost-per-page print engine having at least two development systems, each of which is associated with a different type of black toner.

DETAILED DESCRIPTION

Figure 1:
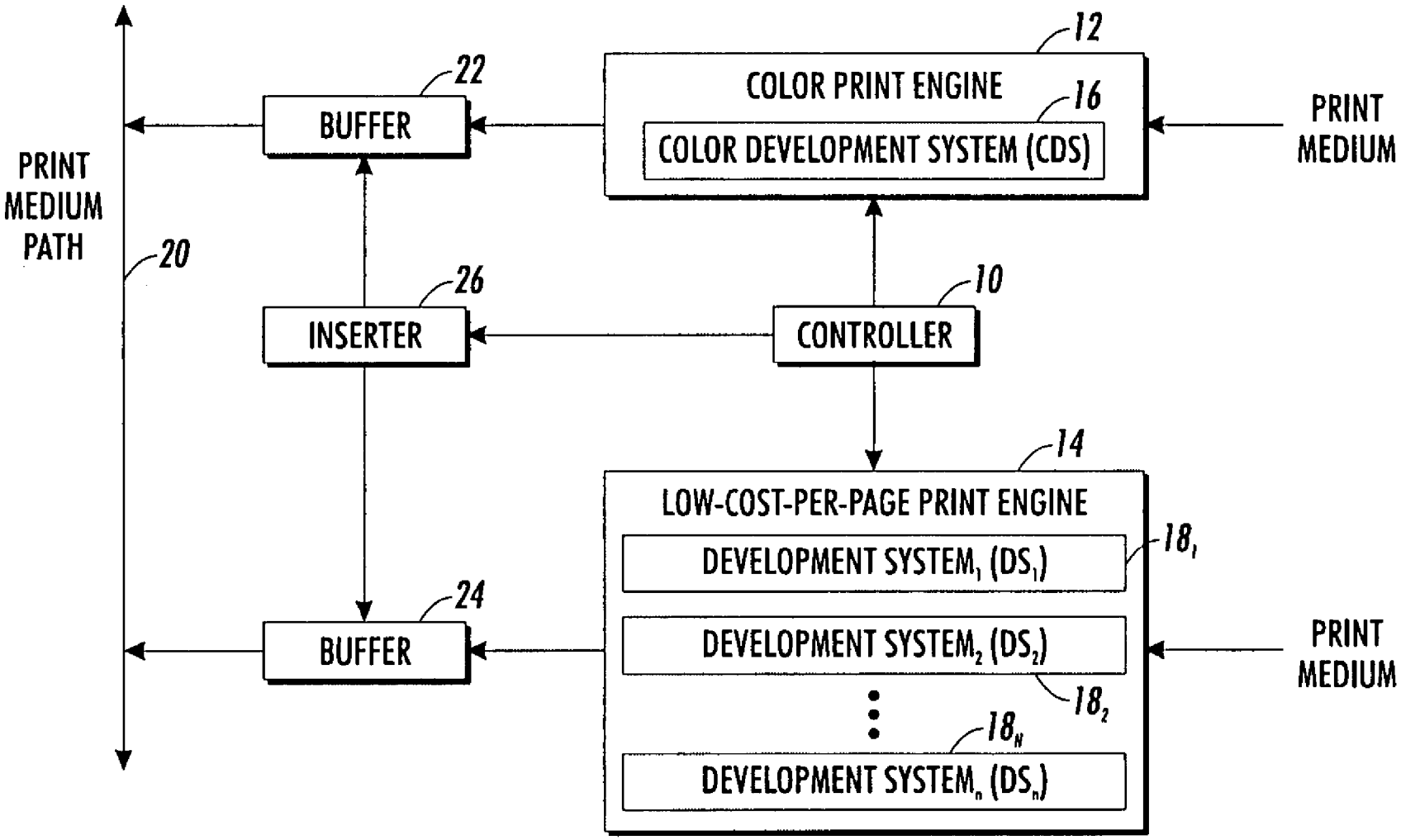
FIG. 1 illustrates a portion of a multi-purpose printing platform having a low-cost-per-page print engine with multiple black and/or highlight color development systems.

With reference to FIG. 1, a portion of a multi-print engine print platform (hereafter "print platform") is illustrated. The print platform can be a multi-purpose print platform used to print, fax, copy, scan, email, etc. various information including images, text, graphics, etc. As described in more detail below, the print platform can include a color print engine with color and black toners and a low-cost-per-page print engine with one or more different types of black toner (e.g., flat, low-gloss, semi-gloss, high gloss, magnetic, etc.) and/or highlight color toners. Jobs that include color and black and/or highlight color pages can be processed by using both print engines. The low-cost-per-page print engine typically is low cost in that it facilitates processing pages at a low per page cost relative to color and/or high cost black print engines while providing the productivity and reliability of a typical black only print engine.

The low-cost-per-page print engine includes separate development systems for each different type of black toner and/or highlight color toner. Individual development systems may be associated with various dedicated or common components such as photoreceptors, intermediate transfer elements (e.g., drums, belts, etc.), fusers, etc., as well as other conventional xerographic elements such as photoreceptor cleaners, photoreceptor chargers, expose units (including optics, a laser raster output scanner, LEDs, etc.), charge transfer elements, fusers, finishers, print medium feeders, print medium inserters, etc. Where common components (e.g., a common photoreceptor, a common fuser, etc.) are used for more than one type of black toner, a single black development system may process an entire page or multiple black development systems may process the page, wherein each black development system used processes a different portion of the page.

Leveraging both the color print engine and the low-cost-per-page print engine can improve system performance and reduce cost. For instance, color print engines typically process pages at a lower rate relative to a monochrome black and/or other low-cost-per-page print engine. Thus, by using the color print engine to process color pages and the low-cost-per-page print engine (instead of the color print engine) to process black and white and/or highlight color pages, the average page per minute processing rate can be increased. In addition, the per page cost associated with processing a page typically is greater for a color print engine relative to a low-cost-per-page print engine. Thus, by using both the color and the low-cost-per-page print engines, the total cost of processing the job can be reduced. However, it is to be understood that page-per-minute (ppm) of the low-cost-per-page print engine is independent of whether or not the color print engine is printing, and vice versa. In addition, depending on the types of black toner available, the user can match the black on the color pages and the black on the black and white pages or intentionally use different types of black toners to introduce a difference in the black on the color pages and the black on the black and white pages. The user can also use a plurality of the black development systems for processing a black and white page in order to introduce a difference within the black on a single black and white page. Moreover, such a system provides the capability to deliver a more flexible, "Universal Printer," in which the different black development systems enables a job that has black only pages to be printed at lower cost to the customer and at lower wear on the color engine.

The print platform includes a controller 10, which can include software, firmware, and/or hardware, that controls various components of the printing platform. As depicted, the controller 10 can control at least one or more of a color print engine 12 and a low-cost-per-page print engine 14. Other components controlled by the controller 10 can include, but are not limited to, other color and/or black print engines, displays, fusers, job schedulers, print medium trays, print medium pathways, controls (e.g., physical and software based buttons, knobs, etc.), etc.

The color print engine 12 includes at least a color development system (CDS) 16. The CDS 16 includes a developer (not shown) and housings (not shown) for storing color and black toner. Typically, the color print engine 12 houses a glossy black. However, in various instances, the black toner may be a flat, low gloss, semi-gloss, magnetic, etc. black toner. The color print engine 12 also includes various other xerographic elements (not shown), including, but not limited to, one or more photoreceptors (e.g., drums and/or belts), photoreceptor cleaners, photoreceptor chargers, expose systems (e.g., laser, etc.), intermediate transfer systems (e.g., belts and/or drums), transfer chargers, fusers, finishers, dischargers, etc. One of more of these other components may also be considered as part of the CDS 16.

The low-cost-per-page print engine 14 includes N black and/or highlight color development systems (DSs) $\mathbf{18}_1$, $\mathbf{18}_2, \ldots, \mathbf{18}_N$, (or DSs 18, collectively) wherein N is an integer equal to or greater than one. Each of the DSs 18 includes a developer (not shown) and a housing (not shown) for storing a different type of black toner or a highlight color toner. For example, the DS $\mathbf{18}_1$, may include a housing for storing a flat black toner, the DS $\mathbf{18}_2$ may include a housing for storing a semi-gloss black toner, . . . , and the DS $\mathbf{18}_N$ may include a housing for storing a glossy black toner. It is to be understood that the foregoing example is provided for explanatory purposes and is not limiting. Thus, each of the DSs 18 may include a different toner, including a toner suitable for Magnetic Ink Character Recognition (MICR), which includes a magnetized toner, or a highlight color toner. Thus, the DS $\mathbf{18}_1$ may alternatively include a housing for storing a low gloss, a semi-gloss, a gloss, a MICR, etc. black toner or a highlight color toner. The low-cost-per-page print engine 14 also includes various xerographic elements (not shown), including, but not limited to, one or more photoreceptors (e.g., drums and/or belts), photoreceptor cleaners, photoreceptor chargers, expose systems (e.g., laser, LED, etc.), intermediate transfer systems (e.g., belts and/or drums), transfer chargers, fusers, finishers, dischargers, etc. In some instances, one or more of these elements may be considered as part of the DSs 18, and each of the DSs 18 may be associated with one or more common or individual elements such as common photoreceptors and/or common fusers.

Various types of print medium or print substrate can be provided to the print engines 12 and 14 via one or more feeders in which each feeder may provide print medium, individually and/or in combination with at least one other feeder, to at least one of the print engines 12 and 14. Examples of suitable print medium include, but are not limited to, paper, plastic, velum, silicon, and ceramic. The print medium can be supplied to the print medium feeder system via one or more trays or the like, a print medium path (e.g., feeding print medium at least partially processed by another print engine(s)), and/or via manual feed by a user. The particular source of the print medium can be determined by the controller 10, a user (e.g., via manual selection of the source), a default configuration, a customized configuration, at least one characteristic (e.g., the number of pages in a job, whether there is color and/or black and white pages, etc.) of a job, a status of a component(s) (e.g., empty paper tray, non-functional paper tray, busy paper tray, etc.), etc.

One or more jobs received by the print platform are processed by one or both of the color print engine 12 and low-cost-per-page black print engine 14. The one or more jobs can be initiated at the print platform (e.g., via controls, menus, etc. thereon), a computer, another print platform, etc. The controller 10 and/or other component(s) (not shown) analyze the one or more jobs and determine whether each job includes color, highlight color, and/or black and white pages. It is to be understood that as used herein the term "highlight color page" can include highlight color and black or just highlight color. For each job, the controller 10 sends the color pages to the color print engine 12 for processing and the highlight color and/or black and white pages to the low-cost-per-page print engine 14. With duplex printing, if at least one side of the print medium includes color, then both sides of the print medium typically are processed with the color print engine 12, regardless of whether the other side only includes highlight color and/or black and white regions. However, on some instances, one side of a page can be processed with the color print engine 12 and the other side can be processed by the low-cost-per-page print engine 14.

The controller 10 also controls which of the DSs 18 is (are) used to process the highlight color and/or black and white pages. In one instance, only one of the DSs 18 is used to process each page. In this instance, the other DSs 18 typically reside in an inactive state, while the one DS 18 processes the page. In another instance, two or more DSs 18 are used to process a page. In this instance, the first DS 18 used to transfer the initial image can be interactive, whereas any subsequent DSs 18 contributing to the image are non-interactive in that they do not disturb the initial image and self-contaminate. That is, subsequent DSs 18 do not interact with the image developed on the photoreceptor by a previous one of the DSs 18. This mitigates mixing different types of black (e.g., a flat with a gloss, etc.) on the same page. Byway of example, where a page is processed by DS $\mathbf{18}_1$, $\mathbf{18}_2$, and $\mathbf{18}_N$, DS $\mathbf{18}_1$ may be interactive and DSs $\mathbf{18}_2$ and $\mathbf{18}_N$, may be non-interactive. In another example, where a page is processed by either DS $\mathbf{18}_1$ or DS $\mathbf{18}_2$, and DS $\mathbf{18}_N$, DSs $\mathbf{18}_1$ and/or $\mathbf{18}_2$ may be interactive and DSs $\mathbf{18}_N$ may be non-interactive. DSs associated with highlight color toner typically are non-interactive development systems. If, the registration between two of the black DSs 18 and/or a black DS 18 and a highlight color DS 18 is held relatively tight, then two different types of toners (e.g., two different types of black toner or a black and a highlight color toner) could be located very close to one another, on a page. Examples of conventional systems with tight registration between black and color include the Xerox 4850 and the Xerox 4890 printers.

The particular DS(s) 18 used can be selected by the user and/or automatically selected by the controller 10 (e.g., via a predetermined default DS, intelligence using inferences, probabilities, a priori information, etc.). For instance, if the color pages are processed using a glossy toner from the color print engine 12, the user and/or controller 10 may select a DS 18 associated with a glossy black toner in order to provide color consistency across the processed pages. In this instance, the job is processed more efficiently relative to using the color print engine 12 to print all (color and black and white) pages since low-cost-per-page print engines such as monochrome black or the like are associated with a relatively higher page per minute rate. In another instance, the user and/or controller 10 may select a DS 18 associated with a black toner that is different from the color print engine black toner in order to generate a visually noticeable difference, for example, to distinguish between the black from the print engines 12 and 14. Moreover, the user and/or controller 10 may select multiple different toners for processing one or more of the black and white pages. Typically, the rate of each of the DSs 18 is substantially similar and faster than the processing rate of the CDS 12. Thus, system performance is improved regardless of which and/or how many of the DSs 18 are used to process the black and white pages.

Print medium, after an image is transferred and fused thereto, is conveyed to a print medium path 20. As depicted, the color print engine 12 and the low-cost-per-page print engine 14 can be associated with a buffer 22 and a buffer 24, respectively. The buffers 22 and 24 are used to facilitate suitably inserting processed print medium into the print medium path 20. For instance, a print job may include color, highlight color, and/or black pages, wherein the color print engine 12 is used to process the color pages and the low-cost-per-page print engine 14 is used to process the highlight color and/or the black and white pages. The buffers 22 and 24 can be used to hold, if needed, processed pages until they can be correctly inserted or merged into the print medium path 20. In instances where one or both of the buffers 22 and 24 are not needed, the buffers 22 and/or 24 can be bypassed. An inserter 26, which may be controlled by the controller 10, can coordinate insertion of the processed print medium into the print medium path 20.

Figure 2:
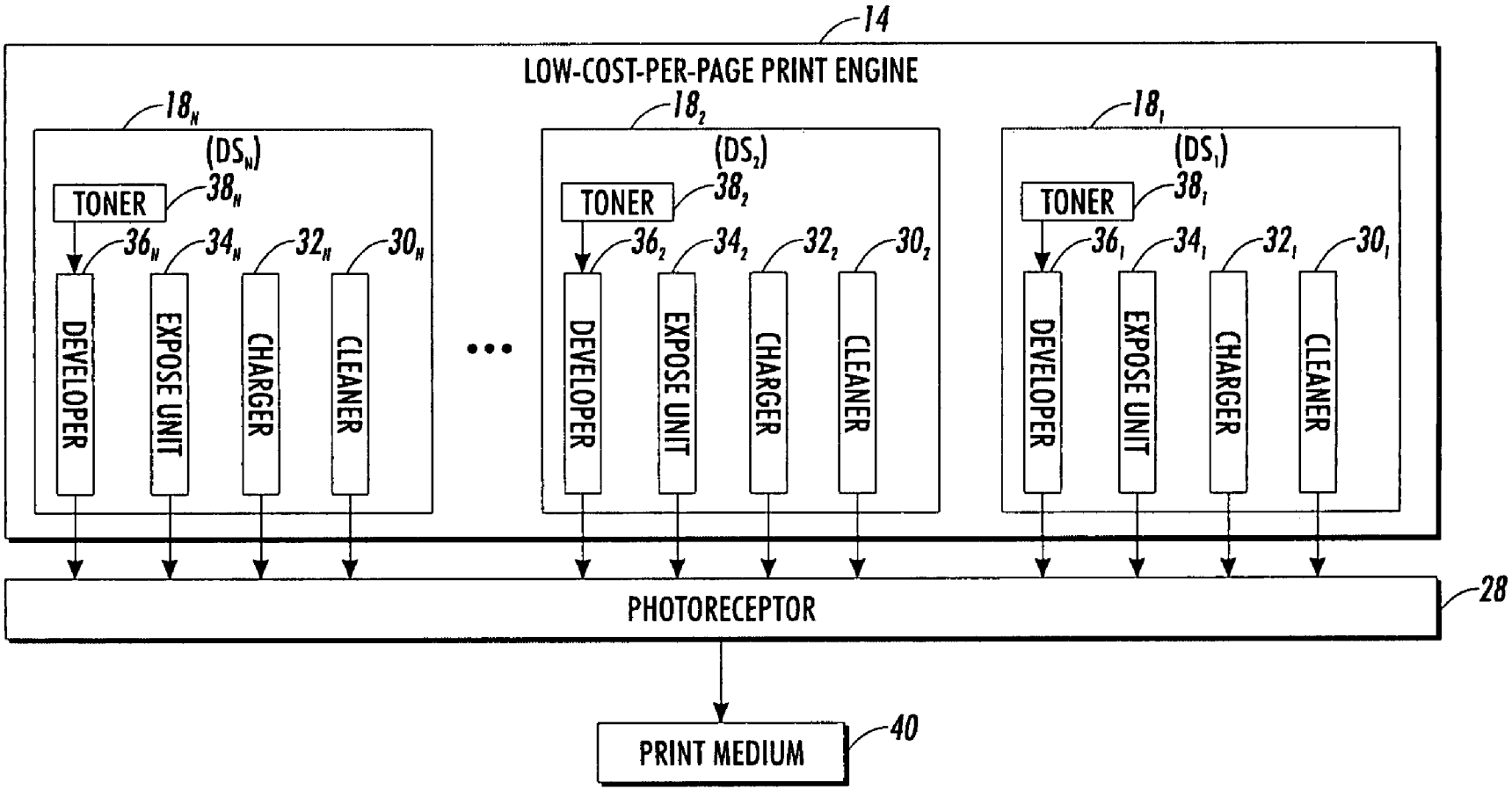
FIG. 2 illustrates an exemplary multi-toner low-cost-per-page printing engine.

FIG. 2 illustrates a portion of an exemplary low-cost-per-page print engine having a plurality of development systems (DSs) with different types of black and/or highlight toners. This low-cost-per-page print engine can be used as the black low-cost-per-page engine 14 described in connection with FIG. 1 above.

The DSs 18 are disposed adjacent to a common photoreceptor 28, which can be a belt, a drum, or the like. As illustrated, each of the DSs $\mathbf{18}_1$, $\mathbf{18}_2$, . . . , $\mathbf{18}_N$ can include a photoreceptor cleaner ("cleaner") $\mathbf{30}_1$, $\mathbf{30}_2$, . . . , $\mathbf{30}_N$, (collectively referred to herein as cleaners 30), a photoreceptor charger ("charger") $\mathbf{32}_1$, 318, . . . , $\mathbf{32}_N$, (collectively referred to herein as chargers 32), an expose unit $\mathbf{34}_1$, $\mathbf{34}_2$, . . . , $\mathbf{34}_N$, (collectively referred to herein as expose units 34), and a developer $\mathbf{36}_1$, $\mathbf{36}_2$, . . . , $\mathbf{36}_N$, (collectively referred to herein as developers 36), each with a toner housing $\mathbf{38}_1$, $\mathbf{38}_2$, $\mathbf{38}_N$, (collectively referred to herein as toner housings 38), respectively. Each of the cleaners 30 can clean the common photoreceptor 28, each of the chargers 32 can create a charge on a surface of the common photoreceptor 28, each of the expose units 34 can expose the surface of the common photoreceptor 28 in order to create a latent electrostatic image on the surface, and each of the developers 36 can develop the image using its corresponding toner 38. With multiple cleaners, the sequences of such cleaners typically is controlled such that the cleaner operating at any one time is the one in the first development system being used for a given page. In some instances, a single common cleaner is shared across DSs 18.

In this example, the photoreceptor 28 is common to all of the DSs 18. As describe above, in instances in which only one of the DS 18 is used to process a black and white page, the other DSs 18 typically remain in an inactive state. For example, if the DS $\mathbf{18}_1$ is used to process the black and white page, the DS $\mathbf{18}_2$,-$\mathbf{18}_N$ remain inactive and do not contribute to the black and white page, while DS $\mathbf{18}_1$ is used to clean and create a charge on the surface of the photoreceptor 28, produce a latent electrostatic image on the charged surface, and develop the exposed surface using its toner. The images is then transferred to the photoreceptor 28 and subsequently transferred to print medium 40. The print medium 40 is then conveyed to a fuser (not shown), which fixes the image to the print medium 28. The fuser used may be common to all of the DSs 18 and include a common or individual configurations (e.g., specifying set points, etc.) or include a different fuser for each of the DSs 18, as described in detail below. The print medium 28 is then suitably inserted into the print medium path 20.

In instances where multiple DSs 18 are used to process a black and white page, the first of the DSs 18 used transfers a portion of the image can be interactive while the remaining DSs 18 that contribute to the final image are non-interactive so that they do not disturb the image created by the first of the DSs 18. The non-interaction also mitigates self-contamination of the remaining DSs 18 by the toner applied by the first of the DSs 18 used.

Figure 3:
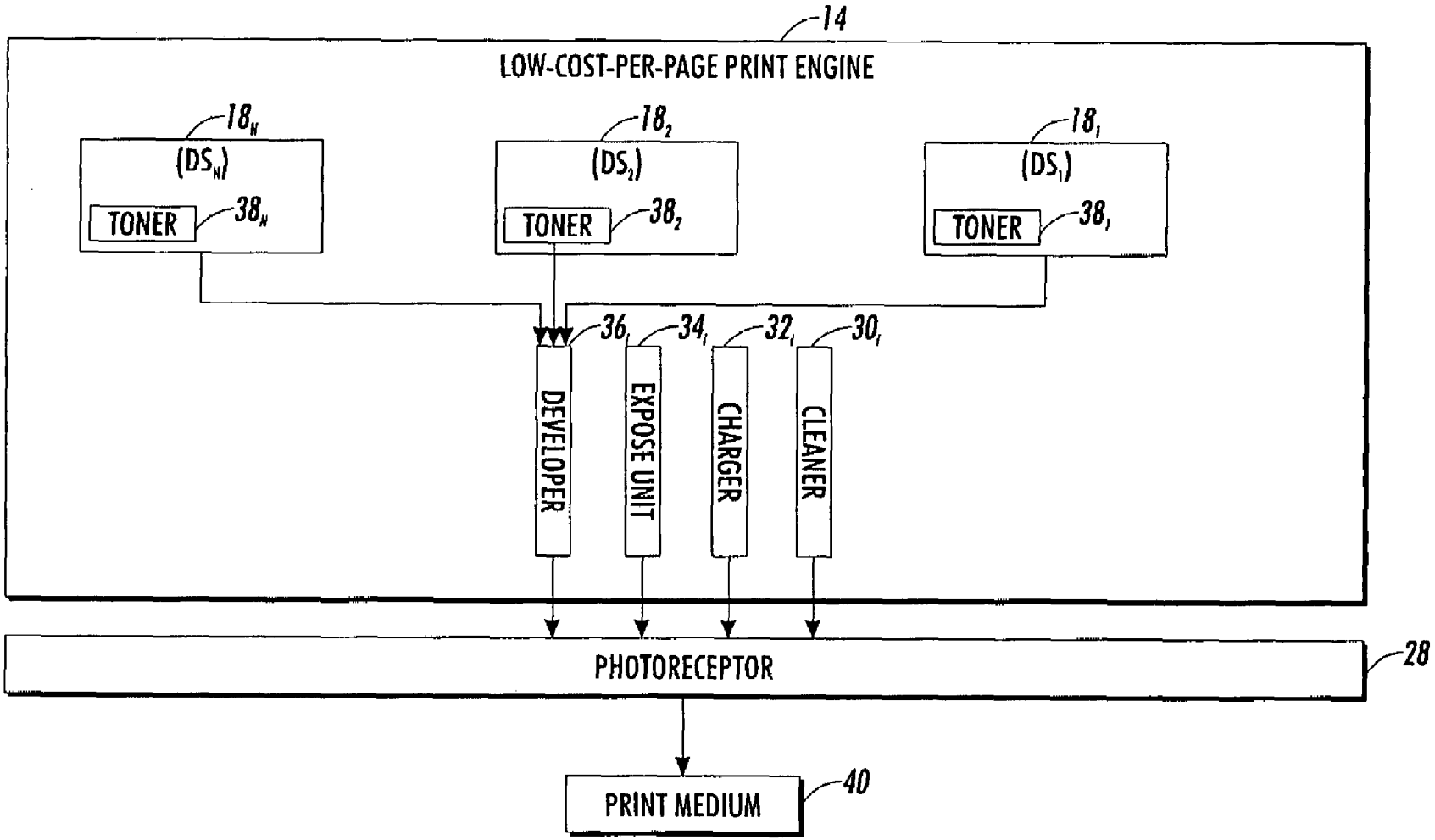
FIG. 3 illustrates another exemplary multi-toner low-cost-per-page printing engine.

FIG. 3 illustrates an alternative configuration in which each of the DSs 18 provide a different type of black toner (e.g., flat, low gloss, semi-gloss, gloss, magnetic, etc.) and/or highlight toners to a single developer $\mathbf{36}_i$. With this configuration, a cleaner $\mathbf{30}_i$ cleans the photoreceptor 28, a charger $\mathbf{32}_i$ create a charge on a surface of the photoreceptor 28, an expose unit $\mathbf{34}_i$ create a latent electrostatic image on a surface of the photoreceptor 28, and the developer $\mathbf{36}_i$ develops the image using one of the toners 38. The image is subsequently transferred to the photoreceptor 28, optionally to one or more of the intermediate transfer elements 42, and then to the print medium 40.

Figure 4:
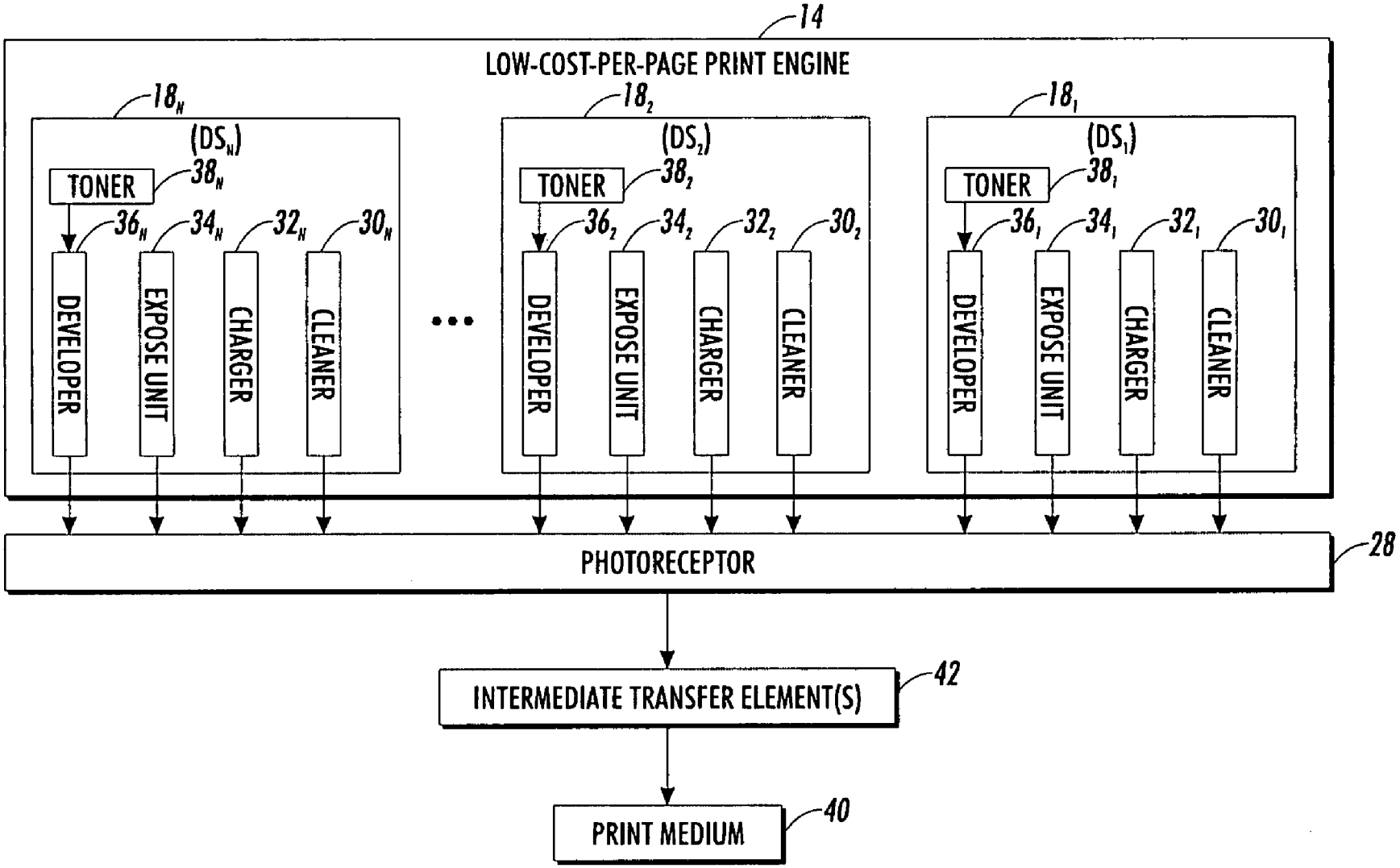
FIG. 4 illustrates an exemplary multi-toner low-cost-per-page printing engine used in conjunction with one or more intermediate transfer elements.

FIG. 4 illustrates the portion of the exemplary low-cost-per-page print engine described in FIG. 2 in which one or more intermediate transfer elements 42 are used to facilitate transferring the image from the photoreceptor 28 to the print medium 40. As describe above, the photoreceptor28 can be a drum, a belt, or the like. Similarly, the one or more intermediate transfer elements 42 can include one or more drums, belts, combination of drums and belts, and the like. In this example, the image on the surface of the photoreceptor 28 is transferred to one or more of the one or more intermediate transfer elements 42, and subsequently transferred therefrom to the print medium 40 and inserted into the print medium path 20. The print medium 40 is then conveyed to a fuser (not shown) that fixes the image to the print medium 40 and conveyed to an another component such as an output tray or the like.

Figure 5:
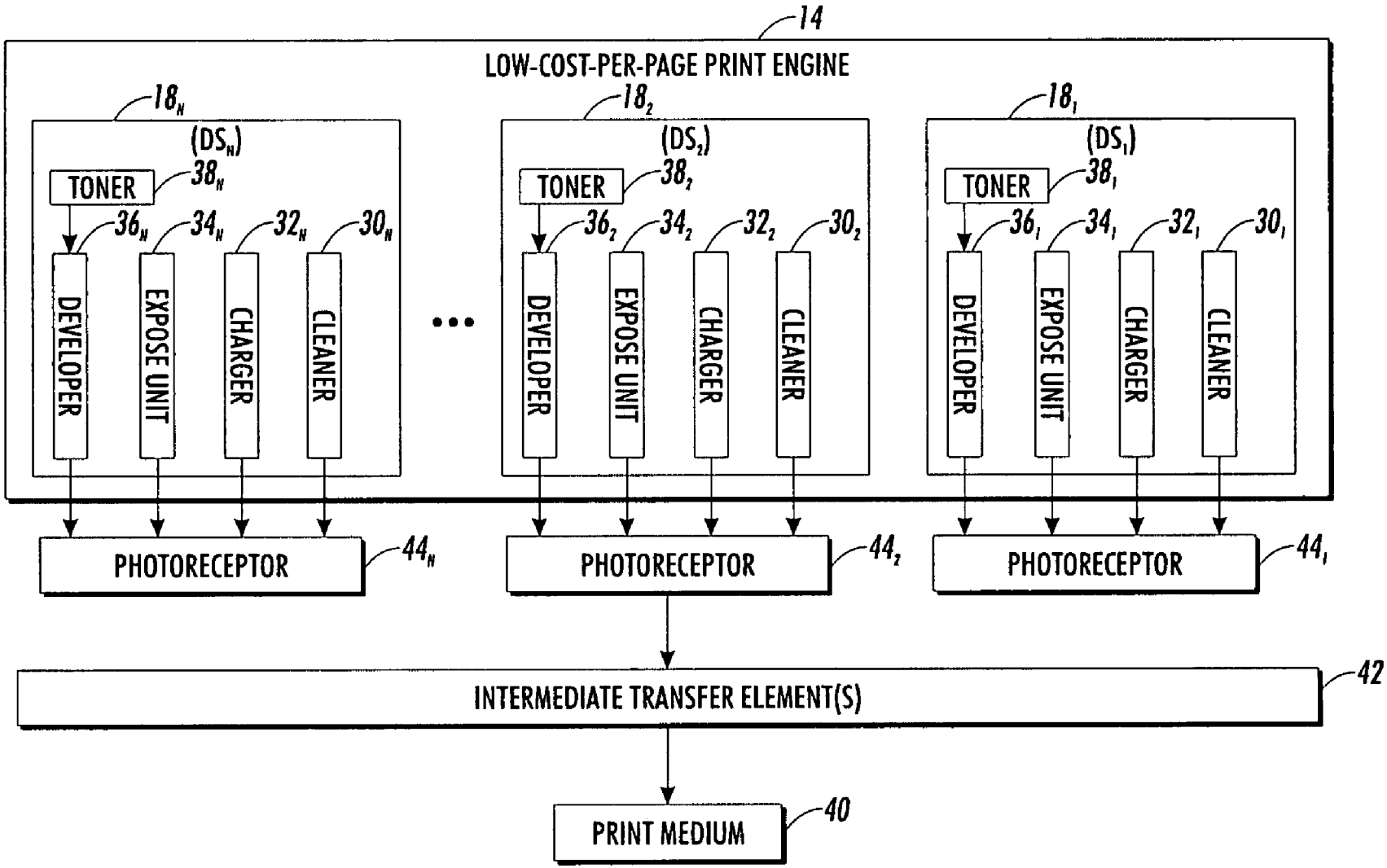
FIG. 5 illustrates an exemplary multi-toner low-cost-per-page printing engine used in conjunction with one or more photoreceptors and intermediate transfer elements.

FIG. 5 illustrates another configuration of the low-cost-per-page print engine 14 in which each of the DS $\mathbf{18}_1$, $\mathbf{18}_2, \ldots, \mathbf{18}_N$ is associated with an independent photoreceptor $\mathbf{44}_1, \mathbf{44}_2, \ldots, \mathbf{44}_N$, respectively, and the intermediate transfer element(s) 42. In another instance, one or more of the DSs 18 can also be associated with its own intermediate transfer element(s) (not shown). If only one of the DSs 18 (e.g., the DS $\mathbf{18}_1$) is used to process a black and white page as described above, the remaining DSs 18 (e.g., DS $\mathbf{18}_2$,-$\mathbf{18}_N$) do not contribute to the black and white page. In instances where multiple DSs 18 are used to process a black and white page, any or all of the DSs 18 can be interactive or non-interactive.

Figure 6:
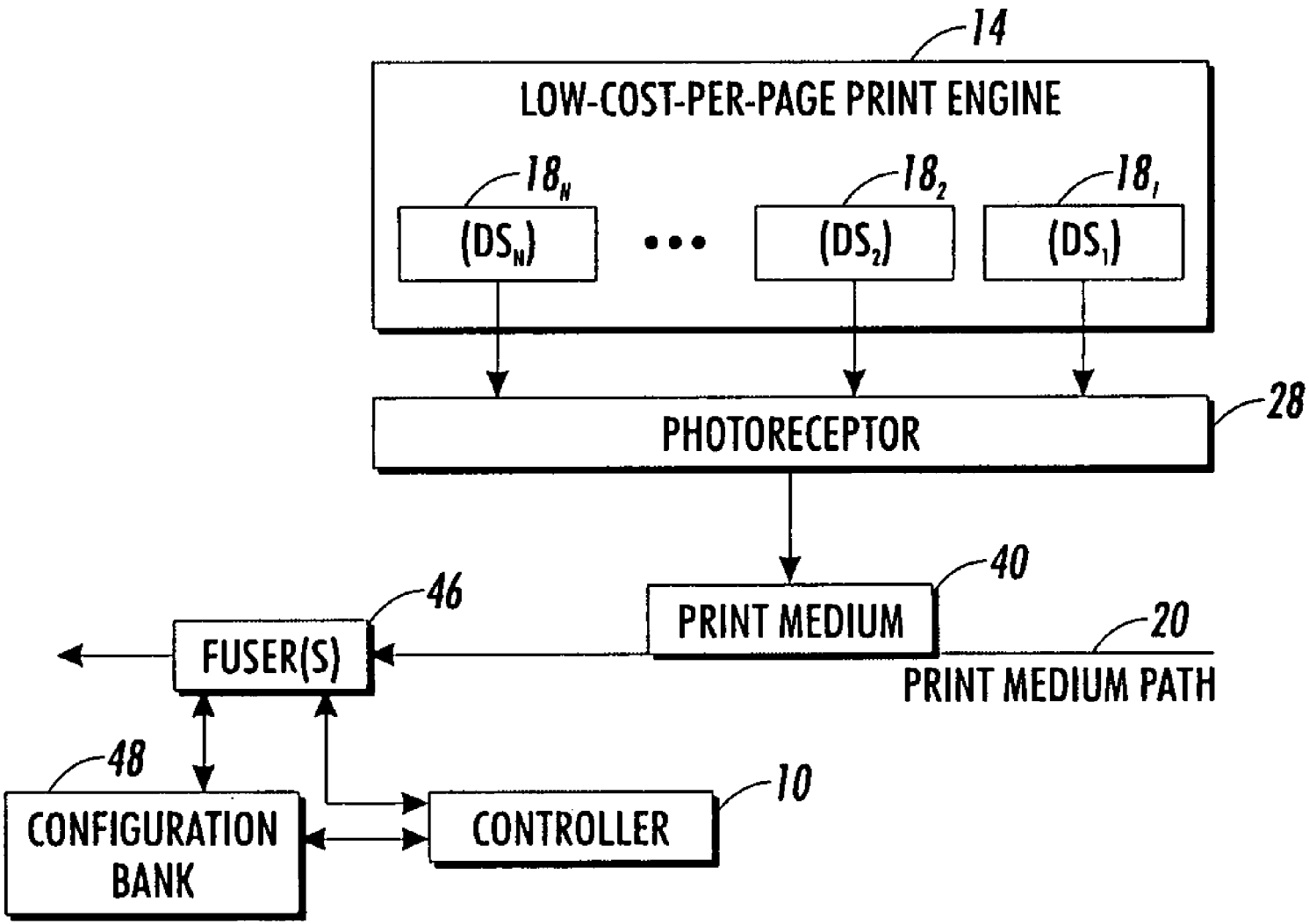
FIG. 6 illustrates an exemplary fusing system for a multi-toner low-cost-per-page printing engine.

FIG. 6 illustrates an exemplary fusing system 46 that can be used in connection with the low-cost-per-page print engine 14. For explanatory purposes and sake of brevity, the low-cost-per-page print engine configuration described in FIG. 2 is illustrated. However, it is to be understood that the configurations described in connection with FIGS. 3 and 4, variations thereof, and/or other configurations can be used.

After an image has been transferred to the photoreceptor 28 via on or more of the DSs 18, the image is transferred to the print medium 40, and the print medium 40 is inserted into the print medium path 20. The image is then fixed to the print medium 40 via one or more fusers 46. In one instance, a single fuser 46 is used fix images transferred from any of the DSs 18. In this instance, a configuration with a common set point, which can be stored in the configuration bank 48, can be loaded by the controller 10 and used for the DSs 18. However, since the melting point, as well as other characteristics of each type of toner may vary, a configuration with set points for each type of toner can also be used. Depending on the DS 18 used to process the page, the corresponding set point can be obtained from the configuration bank 48 and loaded by the controller 10. In instances in which multiple DSs 18 are used to process the page, a single set point may be loaded and used for the multiple DSs 18 or the set point can be changed based on the DS 18 used to process the portion of the image being fixed by the single fuser 46. Thus, different set points can be used to suitably adjust the single fuser 46 when fixing an image created by two or more of the DSs 18. In another instance, the fusers 46 may include a separate fuser for each of the DSs 18, wherein each of the fusers uses a set point from a configuration corresponding to the toner used by its associated DS 18.

Figure 7:
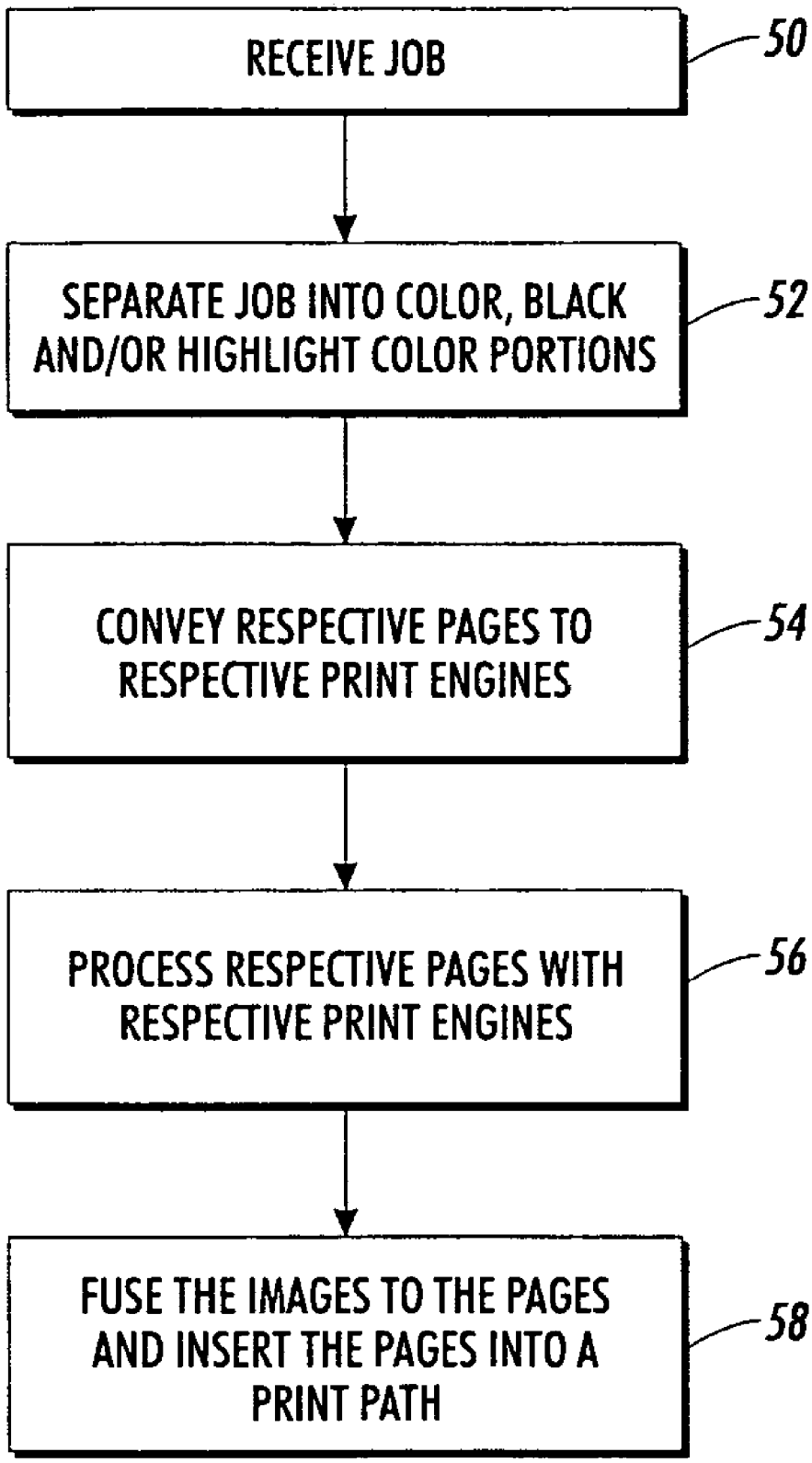
FIG. 7 illustrates an exemplary method for printing with a multi-purpose printing platform having a low-cost-per-page print engine with multiple black and/or highlight color development systems and/or a color print engine.

FIG. 7 illustrates a method for using a multi-print-engine print platform to print color, highlight color, and/or one or more types of black using a color print engine and a low-cost-per-page print engine having a plurality of housing for different types of black and/or highlight color toners. At 88, a print job is received. The job can be provided by various sources. For example, the jobs can be initiated at the print platform, provided by a computer, received from another print platform, etc. At 90, the print job is delineated into color portions and black and/or, highlight color portions. The color portions may include pages with color and highlight color and/or black and/or duplex pages with color on one side and only black and/or highlight color on the other side. At 92, the color pages are conveyed to a color print engine and the black and white and highlight color pages are conveyed to a low-cost-per-page print engine. The low-cost-per-page print engine may include a plurality of housings, each which holds a different type of black toner (e.g., flat, low gloss, semi-gloss, high gloss, magnetic, etc.) and/or highlight color toner. At 94, the color print engine processes the color pages and the black print engine processes the black and white pages and/or the highlight color portions. With the low-cost-per-page print engine, one or more of the different types of black toners may be used to create the image on similar and/or different black and white pages. In addition, the particular black toner(s) used may or may not match the black toner associated with the color print engine. At 96, the processed color, highlight color, and/or black and white pages are fused and suitably inserted into a paper path, which conveys the pages to another component, such as an output print medium tray, a finishing device and/or another print engine. As described in detail above, one or more buffers can be used to facilitate suitably inserting processed print medium into the paper path. For example, one or more buffers can be used to hold processed pages until they can be correctly inserted or merged into the paper path.

It will be appreciated that one or more of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A multi-purpose print platform, comprising:

a low-cost-per-page print engine, having at least two image development systems, each associated with a different type of black toner;

at least one color print engine, wherein a color page associated with a first sheet of print medium is processed with the at least one color print engine and a black and white page associated with a second sheet of print medium is processed with the low-cost-per-page print engine; and at least one print medium buffer for buffering at least one of a processed color page and a processed black and white page to facilitate inserting the at least one of the processed color page and the processed black and white page into a paper path.

2. The multi-purpose print platform as set forth in claim 1, wherein the at least two different types of black toner include at least two of the following:

a flat black toner, a low gloss black toner, a semi-gloss black toner, a high gloss black toner, and a magnetic black toner.

3. The multi-purpose print platform as set forth in claim 1, wherein the black and white page is processed with one of a single one of the at least two image development systems and more than one of the at least two image development systems.

4. The multi-purpose print platform as set forth in claim 3, wherein subsequent ones of the at least two image development systems that are used to create an image are non-interactive.

5. The multi-purpose print platform as set forth in claim 1, further including a single fuser that fuses pages processed by the low-cost-per-page print engine.

6. The multi-purpose print platform as set forth in claim 5, wherein the single fuser uses a set point corresponding to a particular black toner when fusing images created with one of the at least two different types of black toner.

7. The multi-purpose print platform as set forth in claim 1, wherein the low-cost-per-page print engine further includes at least one highlight color development system with highlight color toner.

8. The multi-purpose print platform as set forth in claim 1, further including at least one intermediate transfer element that is used to facilitate transferring an image formed by the low-cost-per-page print engine from a photoreceptor to a print medium.

9. The multi-purpose print platform as set forth in claim 1, wherein each of the at least two image development systems is associated with a photoreceptor cleaner, a photoreceptor charger, an expose unit, a developer, and a toner housing.

10. A method for printing pages of a job with different print engines in a multi-engine print platform, comprising:

receiving a job having at least one color page and a least one black and white page;

processing the at least one color page with a color print engine;

processing the at least one black and white page with a low-cost-per-page print engine having a plurality of different black toners; and buffering one of the at least one color page and the at least one black and white page and inserting the buffered page at a suitable location within a paper path.

11. The method as set forth in claim 10, wherein the plurality of different black toners include at least two of the following:

a flat black toner, a low gloss black toner, a semi-gloss black toner, a high gloss black toner, and a magnetic black toner.

12. The method as set forth in claim 10, further including a fusing the black and white page based on one of a set point common to the plurality of black toners and a set point corresponding to the black toner being fused.

13. The method as set forth in claim 10, further including transferring an image created by the low-cost-per-page print engine to one of a print medium and one or more intermediate transfer elements.

14. The method as set forth in claim 10, further including:

receiving a job having at least one color page and at least one highlight color page;

processing the at least one color page with a color print engine; and processing the at least one highlight color page with the low-cost-per-page print engine.

15. A xerographic printing system, comprising:

a color print engine;

a black print engine having at least two xerographic development systems in which each of the at least two xerographic development systems is associated with a different type of black toner;

wherein a color page associated with a first sheet of print medium is processed with the color print engine and a black and white page associated with a second sheet of print medium is processed with the black print engine; and at least one print medium buffer for buffering at least one of a processed color page and a processed black and white page to facilitate inserting the at least one of the processed color page and the processed black and white page into a paper path.

* * * * *